United States Patent [19]

Campbell

[11] Patent Number: 4,521,992

[45] Date of Patent: Jun. 11, 1985

[54] RAMP-OPERATED MECHANICAL GATE SYSTEMS

[76] Inventor: Donald C. Campbell, 3600 Oro St., Redding, Calif. 96001

[21] Appl. No.: 547,008

[22] Filed: Oct. 31, 1983

[51] Int. Cl.[3] ..... E05F 13/00

[52] U.S. Cl. ..... 49/269; 49/271; 49/274

[58] Field of Search ..... 49/269, 273, 274, 272

[56] References Cited

U.S. PATENT DOCUMENTS

| | | | |
|---|---|---|---|
| 1,177,467 | 3/1916 | Worland . | |
| 1,426,062 | 8/1922 | Harrington . | |
| 1,628,703 | 5/1927 | White | 49/269 X |
| 1,632,028 | 6/1927 | Keisling | 49/269 X |
| 1,655,328 | 1/1928 | Murphy | 49/269 X |
| 1,668,631 | 5/1928 | Coates | 49/269 X |
| 1,692,821 | 11/1928 | Dobson | 49/269 X |
| 1,894,549 | 11/1933 | Akers . | |
| 2,299,986 | 10/1942 | Hummel | 49/269 X |
| 2,463,392 | 3/1949 | Kennel . | |
| 2,804,705 | 9/1957 | Lusk | 49/274 X |
| 3,581,438 | 6/1971 | Treiber | 49/274 |
| 3,599,372 | 8/1971 | Curtis . | |

*Primary Examiner*—Philip C. Kannan

*Attorney, Agent, or Firm*—Leonard D. Schappert

[57] ABSTRACT

A ramp-operated mechanical gate system, including vertically-swinging gate, sliding gate and side-swinging gate embodiments which utilize collapsible ramps to supply energy to open a gate so that the gate is opened automatically when the collapsible ramp is depressed by an approaching vehicle and is closed automatically when the vehicle drives through the gate and the ramp is no longer depressed.

7 Claims, 20 Drawing Figures

RAMP-OPERATED MECHANICAL GATE SYSTEMS

BACKGROUND OF THE INVENTION

1. Field of the Invention

This invention relates generally to the area of fences and gates; more specifically to mechanical gate systems, and particularly to mechanical gate systems which are operated automatically as a result of the presence of a motor vehicle in close proximity to the gate.

2. Description of the Prior Art

In the past, inventors have directed their efforts toward designing gates and mechanical or electrical systems for opening and closing them. These systems have been cumbersome and have failed to include features necessary to produce a gate attractive in the marketplace, inexpensive to build and relatively simple to maintain.

SUMMARY OF THE INVENTION

The present invention consists of ramp-operated, mechanically automatic gate systems which require no direct human effort for purposes of opening or closing a gate; nor do they require the use of electrical energy, the power source normally required to operate conventional automatic gate openers.

The invention includes a vertically-swinging gate, a sliding gate and a side-swinging gate.

The opening and closing of the gate is accomplished by means of the downward force of vehicle weight exerted upon a collapsible ramp which is mechanically connected to the gate system. The ramp extends outward on both sides of the gate, thereby enabling the gate to be opened automatically from either side. The gate is closed automatically by the use of springs and/or counterweights.

One of the objects of the present invention is to provide gate systems which utilize the weight of a vehicle to open a gate automatically, thereby enabling a driver to pass through the gate without leaving his vehicle to open and close it.

Another object of the present invention is to provide automatic gate systems which do not require the use of electrical energy or physical energy on the part of an individual to open and close a gate, but rather utilize the weight of a vehicle for that purpose.

Another object of the present invention is to provide unique automatic gate systems which are usable in a multitude of circumstances in that vertically-swinging gate, sliding gate and side-swinging gate embodiments are shown.

A further object of the present invention is to provide automatic gate systems which are relatively trouble-free and reliable.

A further object of the present invention is to provide automatic gate systems which automatically close the gate after a vehicle passes through it.

The foregoing objects and benefits, as well as further objects and benefits of the present invention, will be made manifest in the descriptions and claims which follow.

DESCRIPTION OF THE EMBODIMENTS VERTICALLY-SWINGING GATE

In this embodiment, the invention consists of a gate structure and associated structural support and mechanisms required to swing the gate structure upward when a vehicle drives upon a ramp designed for that purpose.

Figure 1:
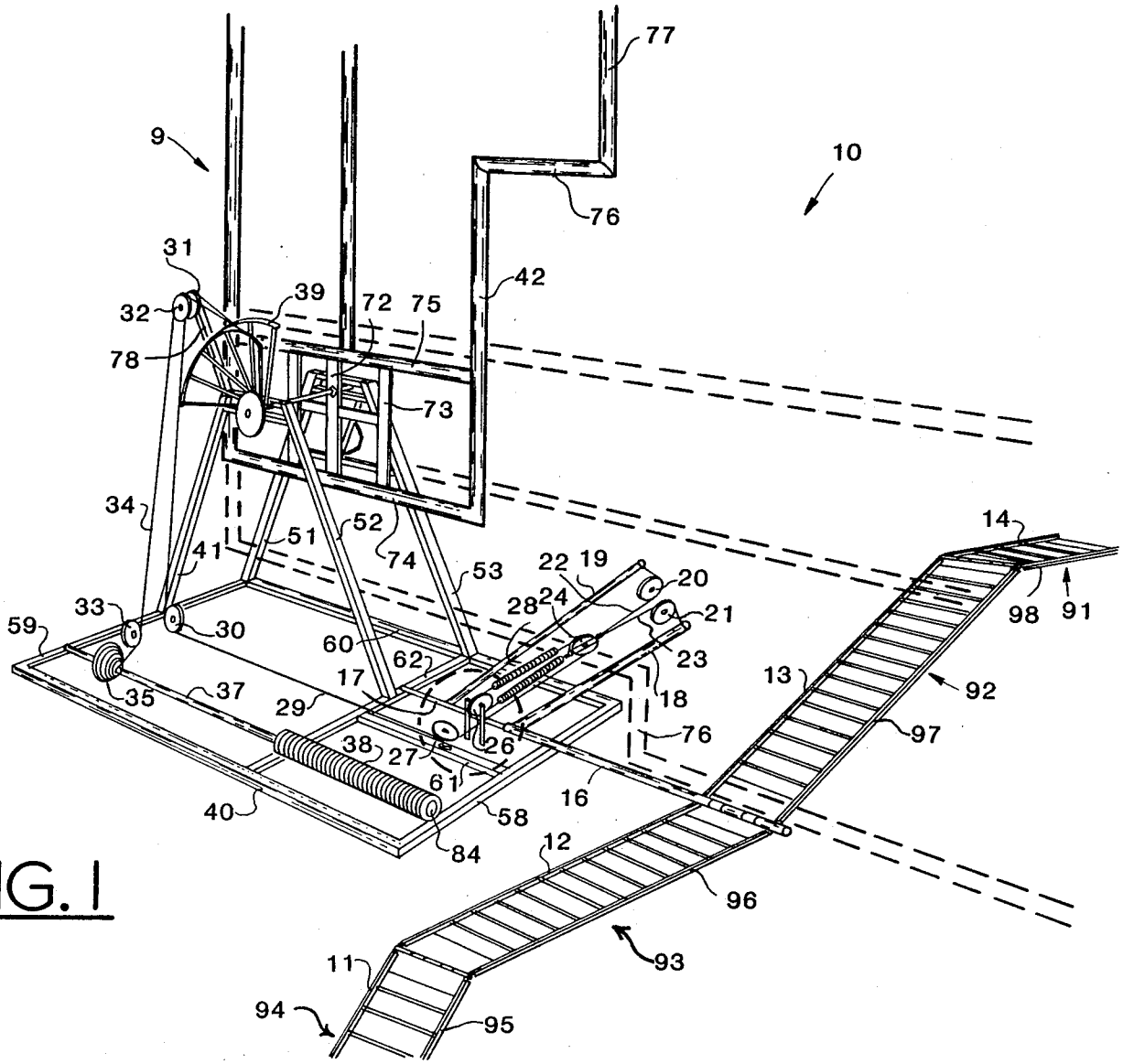
FIG. 1 of the drawings is a perspective view showing the power transfer mechanism of the vertically-swinging gate.

FIG. 1 of the drawings shows a perspective view of the mechanical structure of the vertically-swinging gate system (10) and further shows connection to the ramp structure.

Power for operating the vertically-swinging gate system (10) is derived from a low-profile collapsible ramp structure consisting of sections 91, 92, 93 and 94, which are pivotally attached to each other as shown. The specific construction of the ramp structure is shown in greater detail in FIGS. 5 and 6 of the drawings. When a vehicle is driven onto the ramp structure, its weight depresses the ramp structure and the energy of that movement is transferred through a series of cables, pulleys and springs to gate (9), swinging it upward. When the ramp structure is no longer depressed, the weight of gate (9) is sufficient to close it.

More specifically, when a vehicle depresses ramp sections 91 and 92, round rod 16, which is attached at one end to ramp section 92 and at the other end to lever arm 18, turns, moving lever arm 18 downward. Lever arm 19 is unaffected by this movement because it is connected through round rod 17 to ramp section 93 and it moves upward, but only when ramp section 93 is depressed. When either lever arm 18 is pulled downward by round rod 16, or lever arm 19 is moved upward by round rod 17, they pull respectively on cables 23 or 22, which are attached to pulley 24 and which, as a result of that movement, extend springs 28. Springs 28 exert tension on pulleys 24 26, thus moving cable 29. Cable 29 is routed around pulley 27, pulley 30 and pulley 31 and attached to cam extension 69 of cam wheel 39. Cable 29 pulls cam extension 69, turning cam wheel 39 and lifting gate 9.

Torsion spring 38, which is rigidly attached at point 84 to base structural member 58 and attached at the other end to round rod 37, is relaxed when gate 9 is in a vertical position as shown in this drawing. When gate 9 is in a horizontal position, torsion spring 38 is under tension, and the tension present in torsion spring 38 tends to assist the ramp in lifting gate 9. The tension of torsion spring 38 is communicated by variable-diameter pulley 35 to cam wheel extension 69 through cable 34, which extends over pulleys 32 and 33. Variable-diameter pulley 35 is rigidly attached to round rod 37 and is provided so that the tension of torsion spring 38 through the lifting cycle of gate 9 can be adjusted. Round rod 37 is pivotally attached between base structural members 58 and 59. While such is not necessarily shown specifically in the drawings, the pulleys are all pivotally attached to the structure where appropriate, unless attached between two or more cables.

Figure 2:
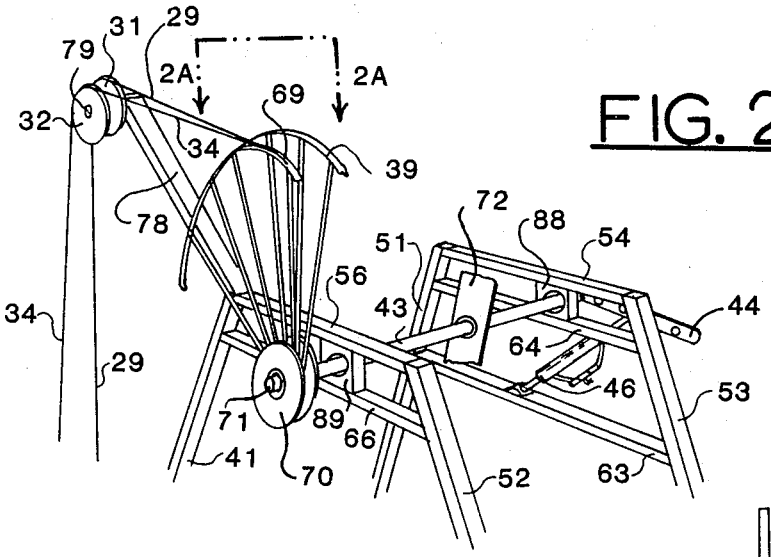
FIG. 2 of the drawings is a perspective view showing an expanded view of the structure shown in FIG. 1.

The structure upon which gate 9 pivots comprises a lower base structure consisting of rods 40, 58, 59, 60, 61 and 62, which are rigidly attached together as shown, and further comprises an A-shaped structure more specifically shown in FIG. 2 of the drawings. This A-shaped structure consists of support rods 41, 51, 52, 53, 54, 56, 63, 64 and 66. Bearing blocks 88 and 89 are provided to support pivot rod 43 and are rigidly attached to support rods 54 and 64 and 56 and 66 respectively. Bar 72 of gate 9 is rigidly attached to pivot rod 43 as shown and, when pivot rod 43 turns as a result of the movement of cam wheel 39, gate 9 is raised into a vertical position. Cam wheel 39 is attached at hub 70 to pivot rod 43 with nut 71.

Figure 2A:
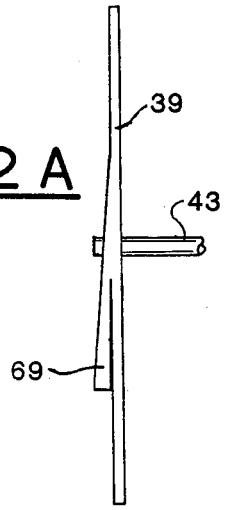
FIG. 2A is a top view of the cam wheel taken along lines 2A—2A of FIG. 2.

FIG. 2A shows more clearly the construction of cam wheel 39 where cam wheel extension 69 joins it.

Figure 3:
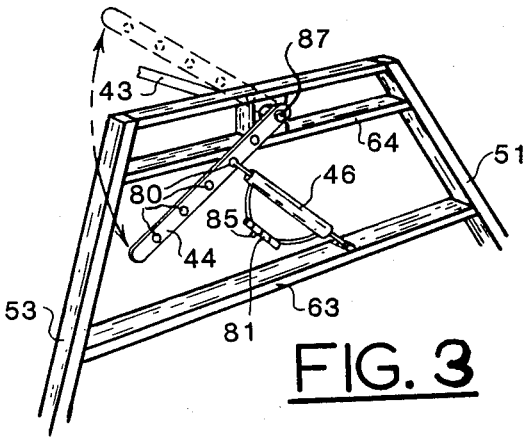
FIG. 3 is a perspective view showing more clearly the support structure which holds the vertically-swinging gate in position.

FIG. 3 is a perspective view showing the positioning of pneumatic recuperator 46. Pneumatic recuperator 46 extends between support rod 63 and holes 80 in adjustment bar 44 and acts as a dampener. Adjustment bar 44 is rigidly attached to the end of pivot rod 43 by nut 87. When gate 9 is raised or lowered as a result of the turning of pivot rod 43, that movement is modified and slowed by pneumatic recuperator 46. The speed at which gate 9 opens or closes can be adjusted by attachment of pneumatic recuperator 46 at different holes 80 in adjustment bar 44. Pneumatic recuperator 46 is pressurized through inflation nipple 85. The speed at which gate 9 is raised or lowered can be modified considerably by means of adjustment of the air pressure and the position of pneumatic recuperator 46 in holes 80.

Figure 4:
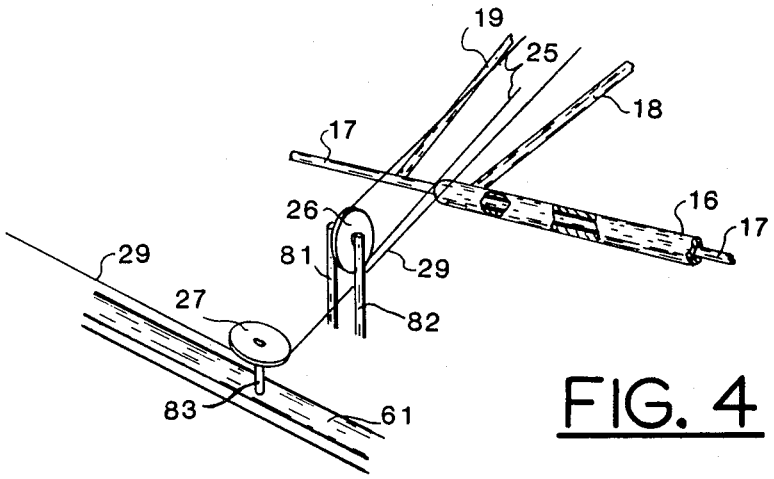
FIG. 4 is an expanded view showing part of the mechanism for transferring power from the ramp to the vertically-swinging gate.

FIG. 4 of the drawings shows round rods 16 and 17, which communicate movement between ramp sections 92 and 93 and lever arms 18 and 19, in greater detail. Round rod 16 is hollow and round rod 17 fits through round rod 16 and turns therein.

Figure 5:
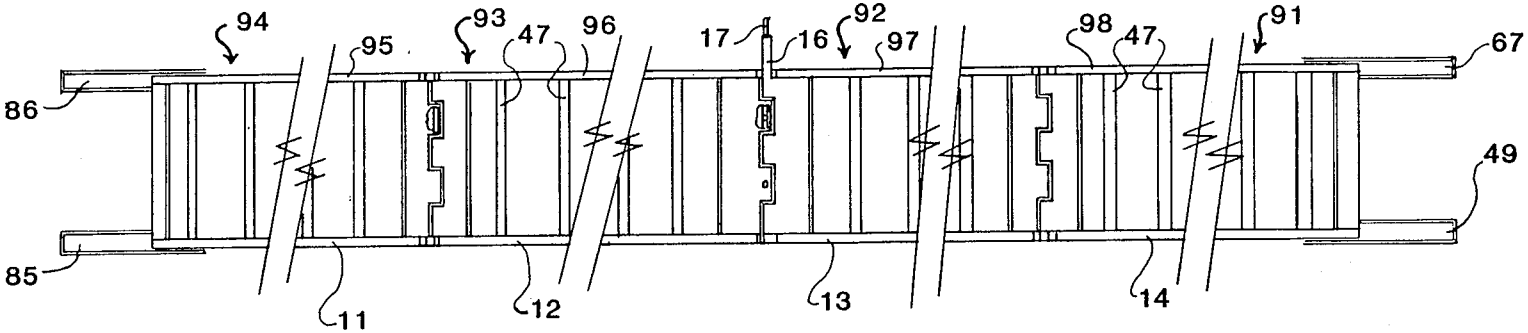
FIGS. 5, 6 and 7 show the construction of the ramp used to supply mechanical energy to each of the gate systems.
Figure 6:
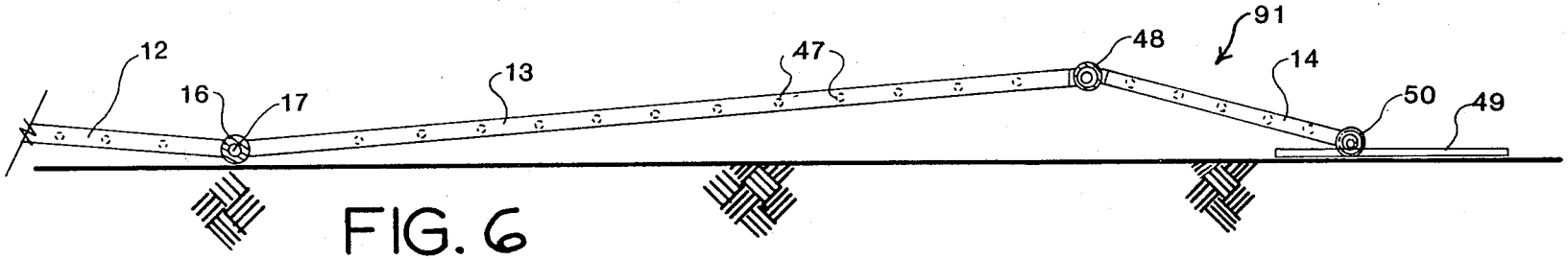
Figure 7:
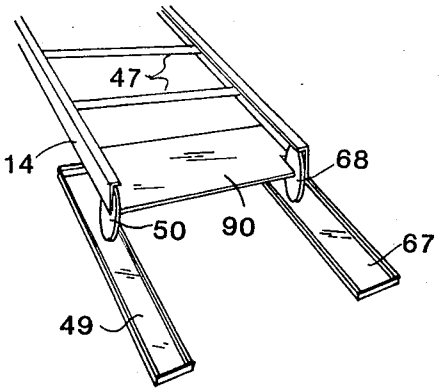

The construction of the ramp structure is shown in greater detail in FIGS. 5, 6 and 7 of the drawings: FIG. 5 is a top view of the ramp structure, FIG. 6 is a side view and FIG. 7 is a perspective view of the end of the ramp showing how the ramp slides during use. Ramp sections 91, 92, 93 and 94 are constructed of side rails, identified here as 11, 12, 13, 14, 95, 96, 97 and 98, with rods 47 extending therebetween. Ramp sections 91 and 92 are hinged with rod 48, as shown in FIG. 6. Troughs 49, 67, 85 and 86 are provided at the ends of the ramp structure and rollers 50 and 68, which roll upon troughs 85 and 86, are provided to facilitate smooth operation as the ramp is depressed. Flat plate 90 is provided to enable a vehicle to enter the ramp more easily. Troughs 49, 67, 85 and 86 are constructed of heavy metal and are rigidly attached to the ground.

SLIDING GATE

In this embodiment, the invention comprises a sliding gate structure 209 which slides to an open or closed position across a driveway, utilizing as a power source the ramp structure previously discussed. The power transfer system used to move the gate laterally, including the springs and pulleys, differs considerably from those used in the vertically-swinging gate and side-swinging gate systems and is therefore described in detail herein.

Figure 8:
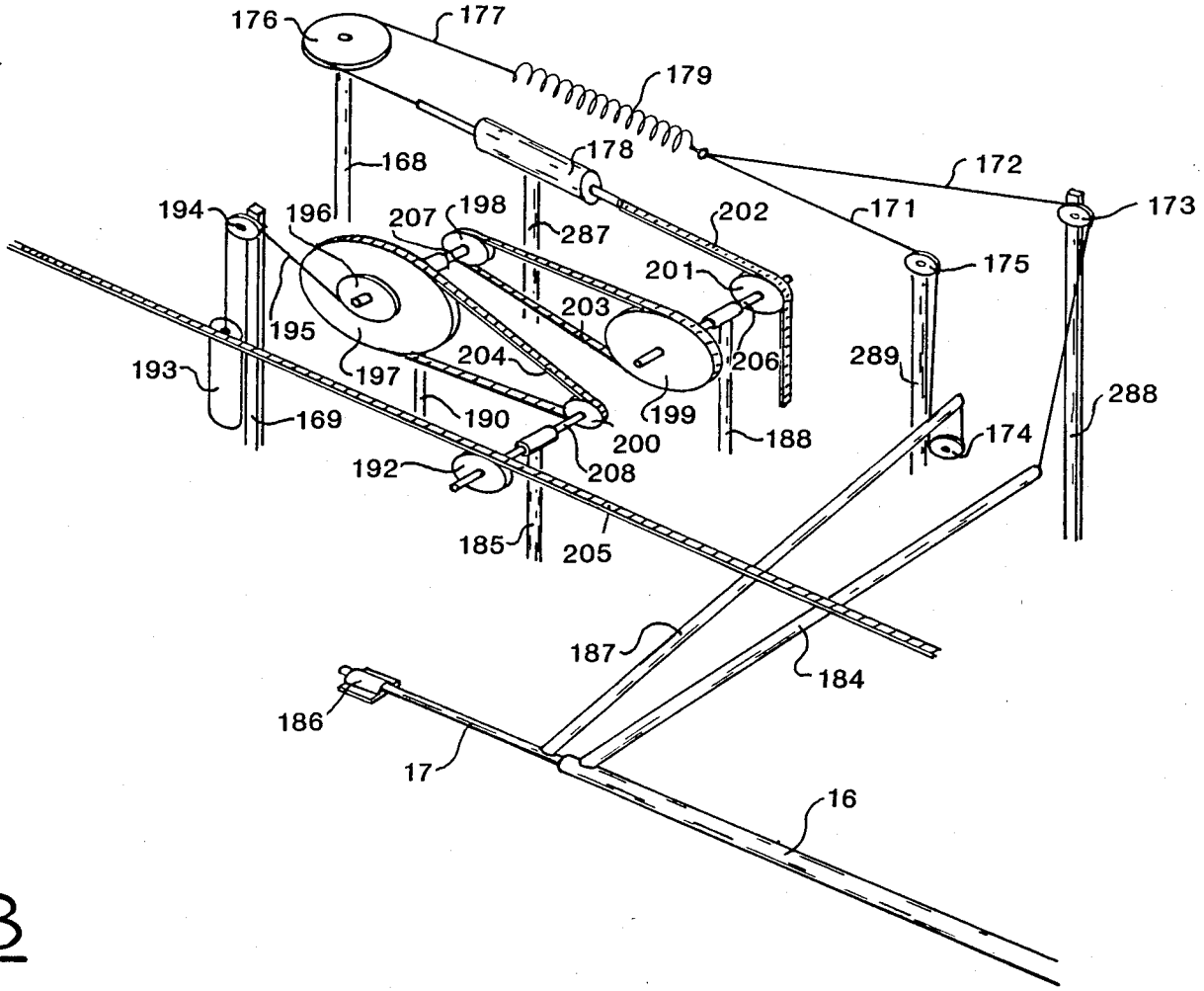
FIG. 8 is a perspective view of the power transfer mechanism utilized in operating the sliding gate system.
Figure 9:
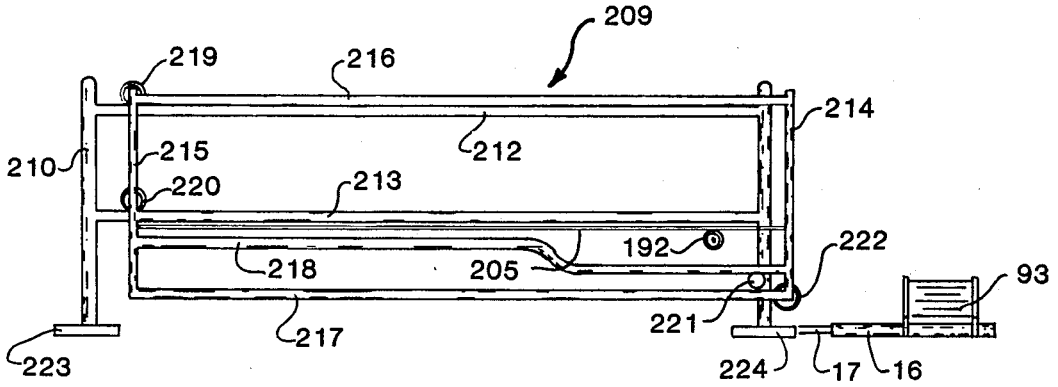
FIG. 9 is a front view showing the structure of the sliding gate and its attachment to the power transfer mechanism shown in FIG. 8.
Figure 10:
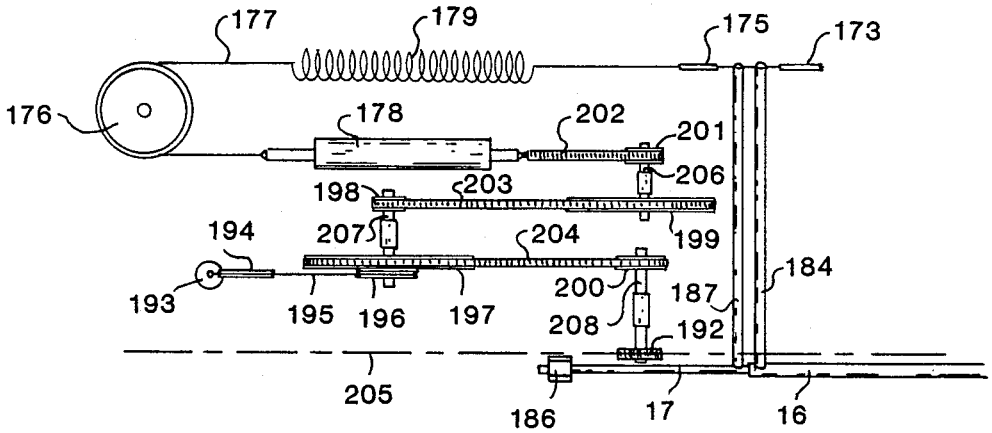
FIG. 10 is a top view of the power transfer mechanism shown in FIG. 8.

As shown in FIGS. 8, 9 and 10 of the drawings, when ramp 93, shown in FIGS. 1 and 9 of the drawings, is depressed by the weight of a vehicle, round rod 17 turns, swinging lever arm 187 upward. Round rod 17 is supported by bearing 186 with respect to base 224. As lever arm 187 swings upward, it pulls cable 171 along pulleys 174 and 175 and extends spring 179, which pulls cable 177 along pulley 176, thereby exerting pressure on pneumatic recuperator 178 and pulling chain 202. Pneumatic recuperator 178 and spring 179 act together to dampen and reduce the speed at which chain 202 turns sprocket 201. As chain 202 turns sprocket 201, sprockets 198 and 199, which are linked by chain 203, are also turned. As sprocket 198 is turned, sprockets 197 and 200, which are linked by chain 204, are also turned. Sprockets 199 and 201 are attached to each other by axle 206, and sprockets 196 and 198 are attached to each other by axle 207. As sprocket 197 turns in a counterclockwise direction, cable 195, which is attached to counterweight 193, winds around pulley 196, lifting counterweight 193 and storing the energy required to close gate structure 209. Sprocket 200 is attached to sprocket 192 by axle 208, and as it turns counter-clockwise, it moves chain 205 laterally and thus causes gate structure 209 to slide open.

When the vehicle moves off the ramp and pressure ceases to be exerted on either ramp section 92 or 93, counterweight 193 pulls cable 195 along pulley 194, turning pulley 196 and sprocket 197 in a clockwise direction and thereby turning sprockets 192 and 200 in a clockwise direction and sliding gate structure 209 laterally toward ramp section 93, closing gate structure 209 and raising the ramp structure. As gate structure 209 slides laterally to the right in the closing operation, its right edge is supported by roller 221, which contacts formed support 218. Formed support 218 is bent so that, when the right end of sliding gate structure 209 clears ramp section 93, the right side of gate structure 209 lowers and is supported on the ground by roller 222.

Gate structure 209 consists of two vertical structural members 214 and 215, two horizontal structural members 216 and 217 and formed support 218, and has a chain 205 stretched tightly between vertical structural members 214 and 215. Rollers 219 and 220 are attached to vertical structural member 215 of gate structure 209 and roll on and are supported by horizontal structural members 212 and 213. Horizontal structural members 212 and 213 are attached to and held permanently in place by vertical base structural members 210 and 211, which are anchored to the ground by base supports 223 and 224.

When a vehicle approaches the driveway from the opposite direction and depresses ramp section 92 rather than ramp section 93, rod 16 turns, swinging lever arm 184 downward and pulling cable 172 along pulley 173, thus exerting pressure on spring 179. The operation of the gate system from that point on in opening and closing is the same as when ramp section 93 is depressed.

Vertical supports 168, 169, 185, 188, 190, 287, 288 and 289 are provided to support the pulleys and sprockets of the power transfer system, and are rigidly positioned with respect to the ground.

The size of sprockets 192, 197, 198, 199, 200 and 201 determines gear ratios and hence the distance gate 209 travels as a result of ramp depression.

SIDE-SWINGING GATE

In this embodiment the invention comprises a gate structure which swings horizontally to an open or closed position, utilizing as a power source the same ramp structure utilized in both the vertically-swinging gate and the sliding gate. However, the power transfer system, including the springs and pulleys, is considerably different and is therefore set out in specific detail herein.

Figure 11:
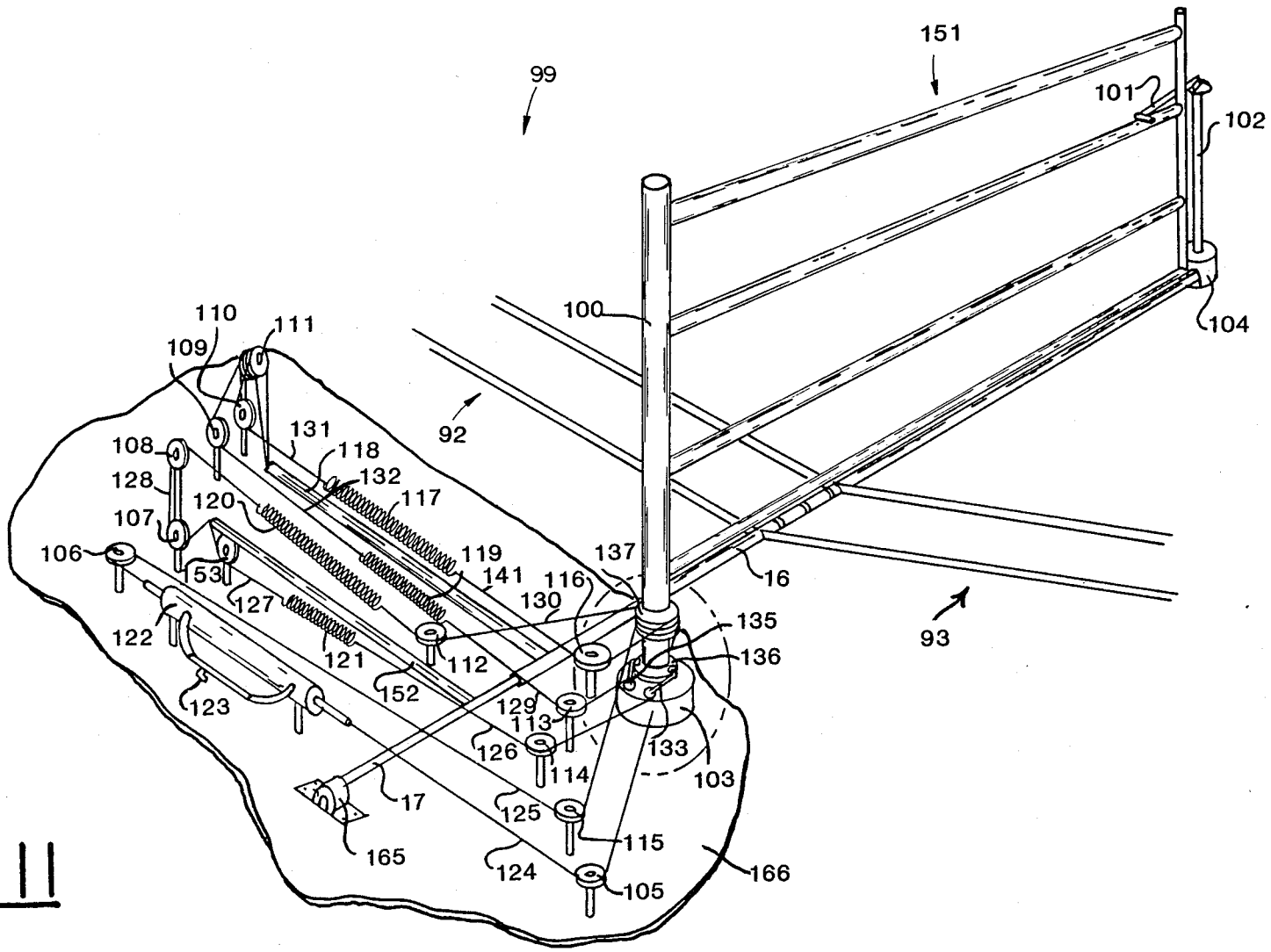
FIG. 11 is a perspective view of the mechanical system utilized in operating the side-swinging gate.

FIG. 11 is a perspective view of a side-swinging gate 99. When ramp section 93 is depressed by the weight of a vehicle, rod 17 turns, swinging lever arm 152 upward. Round rod 17 is supported by bearing 165. When lever arm 152 swings upward, it pulls cables 127 and 128, extending spring 121 and pulling cable 126. Cable 126 extends around pulley 114 and disengages lock lever 133 from locking disk 136, thereby enabling gate structure 151 to pivot and swing outward toward ramp section 92. At the same time, lever arm 152 pulls cable 128 along pulleys 107 and 108, extending spring 120 and pulling cable 130 along pulley 112. Cable 130 is linked to sprocket 137 by chain 139, and as it turns sprocket 137, gate structure 151 opens away from the vehicle and toward ramp section 92. Movement of gate structure 151 as it opens, which would otherwise be relatively rapid, is slowed by spring 120 and pneumatic recuperator 122, which acts as a dampener. Pneumatic recuperator 122 is attached to cables 124 and 125, which extend around pulleys 105, 106 and 115 and attach to chain 140, which engages sprocket 138. As a result of the tendency of pneumatic recuperator 122 to slow down the movement of gate structure 151, the energy realized from the collapsing of ramp section 93 is temporarily stored in spring 120.

When a vehicle approaches from the opposite direction and ramp section 92 is depressed, round rod 16 turns, swinging lever arm 118 downward and pulling cables 131 and 132, which extend spring 119 and pull cable 129. Cable 129 extends around pulley 113 and disengages lock lever 135 from locking disk 136, thereby enabling gate structure 151 to open toward ramp section 93. At the same time, lever arm 118 pulls cable 131 along pulleys 110 and 111, extending spring 117 and pulling cable 141 along pulley 116. Cable 141 is linked to sprocket 137 by chain 139, and as it turns sprocket 137, gate structure 151 opens away from the vehicle and toward ramp section 93. Pneumatic recuperator 122 reacts in the manner previously discussed regardless of the direction in which gate structure 151 opens. When ramp sections 92 and 93 are no longer depressed, gate structure 151 is closed by springs 117 or 120, depending on the direction in which gate structure 151 opened. The pulleys as shown are pivotally attached by pivot pins to base 166, which is constructed generally of concrete or some other appropriate material. Other pulleys are structurally mounted as shown. A latch arm 101, latch mechanism housing 102 and latch mechanism base 104 are shown at the opposite end of gate structure 151 from the mechanism upon which gate structure 151 pivots. The latch mechanism is shown more clearly in FIGS. 15 through 19.

Figure 12:
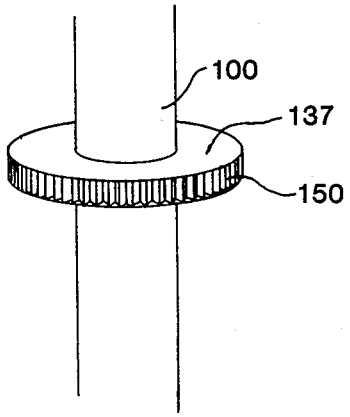
FIG. 12 is an expanded view of a gear shown in FIG. 13.
Figure 13:
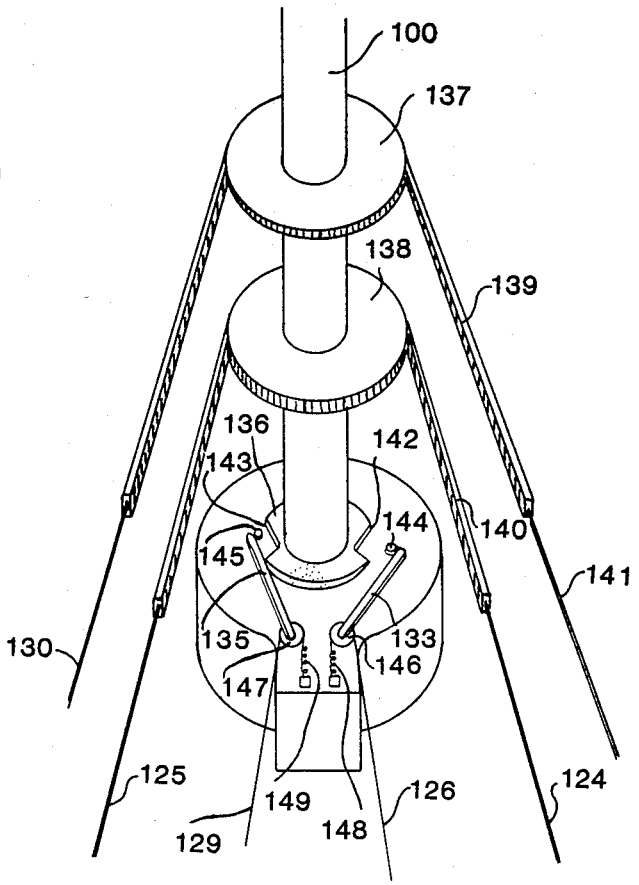
FIG. 13 is a perspective view of the end post and associated parts used in operating the side-swinging gate.

FIGS. 12 and 13 of the drawings show round rod 100, upon which gate structure 151 is mounted, in greater detail. Sprockets 137 and 138 are rigidly attached to round rod 100 and are engaged by chains 139 and 140, to which cables 124, 125, 130 and 141 are attached. Locking disk 136 is cut out at 142 and 143 such that, when lock lever 133 is released, gate structure 151 will open in one direction only, and when lock lever 135 is released, gate structure 151 will open in the opposite direction only. Lock levers 133 and 135 are normally held in a locked position by springs 148 and 149. Cables 126 and 129 are used to activate lock levers 133 and 135.

Figure 14:
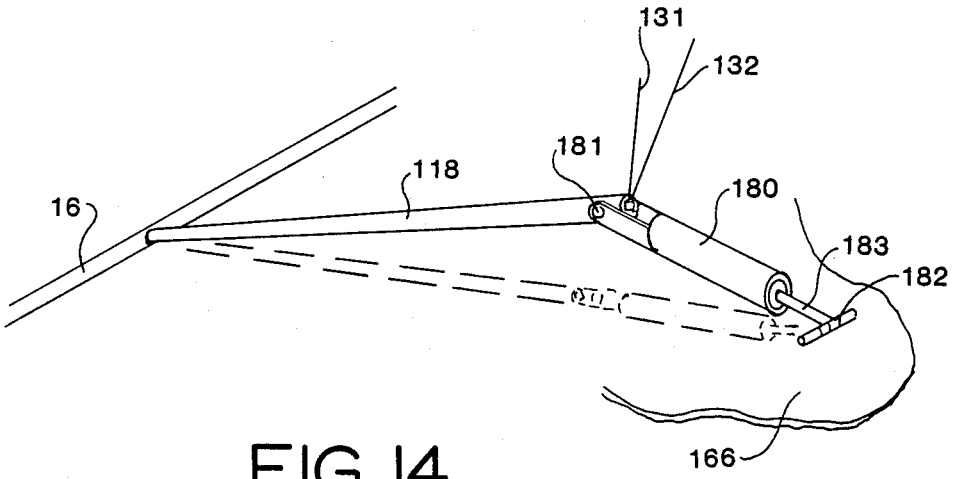
FIG. 14 is an expanded view showing more clearly the lever arm shown in FIG. 11.
Figure 15:
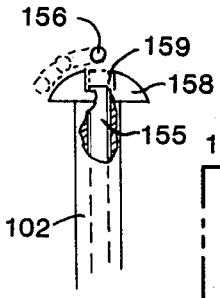
FIGS. 15 and 16 show the locking mechanism used to hold the side-swinging gate in a closed position until a vehicle is driven into place upon the ramp.
Figure 16:
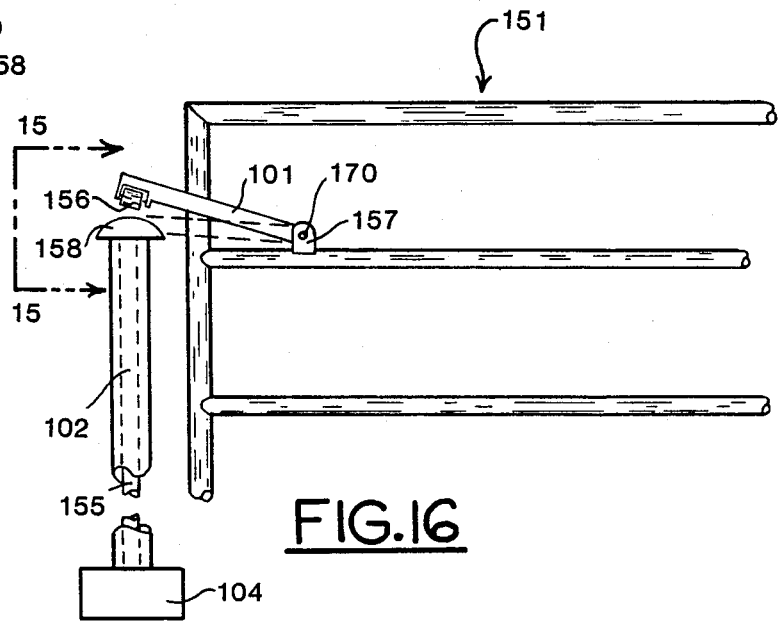
Figure 17:
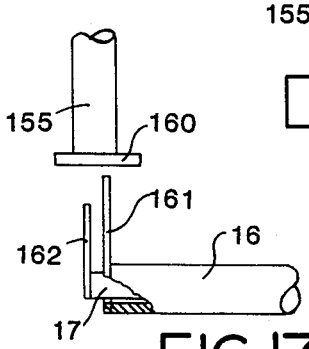
FIGS. 17 and 18 show the operation of the locking mechanism used for unlocking the side-swinging gate prior to opening.
Figure 18:
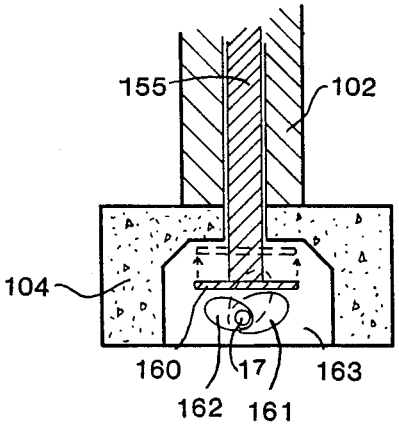

FIG. 14 shows the construction of lever arm 118. Pneumatic recuperator 180, which is pivotally attached to the end of lever arm 118 by pivotal attachment means 181 and to base 166 by pivotal attachment means 182, guides lever arm 118 and acts as a dampener. Lever arm 152 is constructed in a similar manner.

Figure 19:
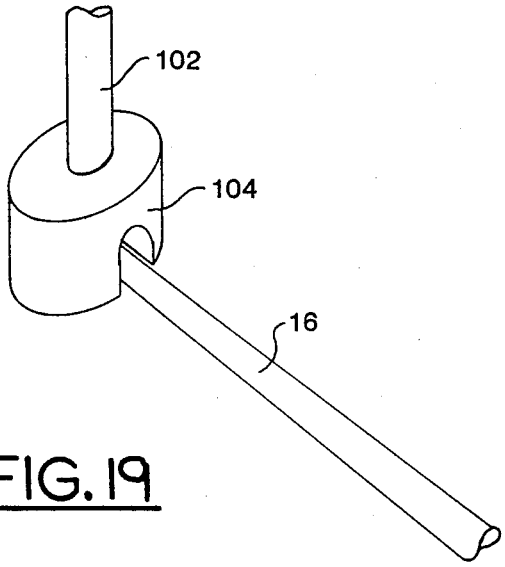
FIG. 19 shows the outside of the locking system enclosure used with the side-swinging gate.

FIGS. 15 through 19 show the latch mechanism used to hold gate structure 151 in a closed and locked position when not in use. Cam 162 is rigidly attached to the end of round rod 17, and cam 161 is attached to the end of round rod 16. When ramp section 92 is collapsed, turning round rod 16, cam 161 turns upward, pushing flat plate 160 upward and moving push rod 155 upward. When ramp section 93 is collapsed, turning round rod 17, cam 162 turns, pushing flat plate 160 upward and moving push rod 155 upward. When push rod 155 is moved upward, it forces latch arm 101 out of slot 159 and unlocks gate structure 151. Push rod 155 extends through hollow latch mechanism housing 102, and dome 158 is placed at the top of latch mechanism housing 102. Dome 158 has a slot 159 designed to accept roller 156 of latch arm 101. Roller 156 slides over dome 158 and into slot 159 without damaging latch arm 101. Latch arm 101 is pivotally attached by pivot pin 170 to gate structure 151 at point 157. Cams 161 and 162, as well as plate 160, are located inside of cavity 163 in latch mechanism base 104. Latch mechanism base 104 is constructed generally of concrete or some other appropriate material. FIG. 19 shows generally the outward appearance and construction of latch mechanism base 104 and associated components.

The ramp-operated mechanical gate systems can also include remote-controlled, radio-activated locking and unlocking systems to provide added security and, which not specifically disclosed herein, such systems are contemplated for use with the present invention.

The foregoing descriptions of embodiments have disclosed specific construction of embodiments at present. However, because improvements and modifications will become readily apparent to those skilled in the art of design and construction of gates and the like, it is applicant's intent not to be limited by any of the foregoing descriptions, but only by the claims which follow.

I claim:

1. A ramp-operated mechanical gate system, comprising:

a gate support structure;

a gate structure pivotally attached to said gate support structure;

a collapsible ramp of sufficient size and strength to withstand the weight of a motor vehicle and offset from said gate support structure;

a first rod rigidly attached to and extending substantially perpendicularly from said collapsible ramp toward said gate support structure which turns when said collapsible ramp is depressed;

a lever arm attached to and extending substantially perpendicularly from said rod, and power transfer means connected between said lever arm and said gate structure such that said gate structure opens when said collapsible ramp is depressed, and having at least one spring.

2. The invention of claim 1, including dampening means to slow movement and reduce vibration of said gate structure.

3. The invention of claim 2, wherein:

said gate support structure consists of a substantially vertical gate post, and said gate structure is pivotally attached to said substantially vertical gate post on a substantially vertical axis such that said gate structure pivots along a substantially horizontal plane.

4. The invention of claim 3, including locking means for holding said gate structure closed until said collapsible ramp is depressed, consisting of:

a second rod rigidly attached to and extending substantially perpendicularly from said collapsible ramp away from said gate support structure which turns when said collapsible ramp is depressed;

a cam attached to said second rod, and latch means activated by movement of said cam.

5. The invention of claim 2, wherein:

said gate support structure includes substantially horizontal pivot means which turn when said first rod turns, and said gate structure is rigidly attached to said substantially horizontal pivot means so that said gate structure swings upward or downward when said substantially horizontal pivot means turn.

6. A ramp-operated mechanical gate system, comprising:

a gate support structure;

a substantially rectangular gate structure slidably attached to said gate support structure;

a collapsible ramp of sufficient size and strength to withstand the weight of a motor vehicle and offset from said gate support structure;

a rod rigidly attached to and extending substantially perpendicularly from said collapsible ramp toward said gate support structure which turns when said collapsible ramp is depressed;

a lever arm attached to and extending substantially perpendicularly from said rod;

power transfer means connected between said lever arm and said substantially rectangular gate structure such that said substantially rectangular gate structure slides open when said collapsible ramp is depressed and having at least one spring, and a counterweight attached to said power transfer means whereby said substantially rectangular gate structure slides closed when said collapsible ramp is released.

7. The invention of claim 6, including dampening means to slow movement and reduce vibration of said substantially rectangular gate structure.

* * * * *